US005772065A

United States Patent [19]

Kalamaras

[11] Patent Number: 5,772,065

[45] Date of Patent: Jun. 30, 1998

[54] SHOT GLASS

[75] Inventor: Michael P. Kalamaras, Fox River Grove, Ill.

[73] Assignee: Howw Manufacturing Company, Inc., Barrington, Ill.

[21] Appl. No.: 876,265

[22] Filed: Jun. 16, 1997

Related U.S. Application Data

[63] Continuation of Ser. No. 678,704, Jul. 11, 1996, abandoned.

[51] Int. Cl.[6] ..... B65D 6/28

[52] U.S. Cl. ..... 220/612; 220/628; 220/602; 220/638; 446/298

[58] Field of Search ..... 220/612, 638, 220/377, 602, 628, 429, 359, 613, 636, 625, 635; 215/376, 377; D7/5, 6; 446/298, 297

[56] References Cited

U.S. PATENT DOCUMENTS

| | | | |
|---|---|---|---|
| D. 301,001 | 5/1989 | Kalamaras et al. . | |
| D. 301,002 | 5/1989 | Kalamaras et al. . | |
| D. 308,456 | 6/1990 | Kalamaras et al. . | |
| 1,561,730 | 11/1925 | Kodama . | |
| 2,505,380 | 4/1950 | Blefeld . | |
| 2,510,237 | 6/1950 | Mahoney . | |
| 2,546,208 | 3/1951 | Barton | 215/376 |
| 2,577,030 | 11/1951 | Neumann | 215/376 |
| 2,598,019 | 5/1952 | Rosenthal et al. . | |
| 2,654,974 | 10/1953 | Rosenthal . | |
| 2,663,866 | 12/1953 | Simpson . | |
| 3,028,035 | 4/1962 | Leong | 215/377 |
| 3,190,952 | 6/1965 | Bitko | 220/612 |
| 4,187,766 | 2/1980 | Gaylord | 220/612 |
| 4,239,223 | 12/1980 | Wilson . | |
| 4,344,113 | 8/1982 | Ditto et al. . | |
| 4,390,928 | 6/1983 | Runge . | |
| 4,616,304 | 10/1986 | Von Kohorn . | |
| 4,678,093 | 7/1987 | Allen . | |
| 4,898,060 | 2/1990 | To . | |
| 4,922,355 | 5/1990 | Dietz et al. . | |
| 5,119,932 | 6/1992 | Semanoff . | |
| 5,123,190 | 6/1992 | Erberber . | |
| 5,125,866 | 6/1992 | Arad et al. . | |
| 5,162,011 | 11/1992 | Frisque . | |
| 5,211,699 | 5/1993 | Tipton . | |

FOREIGN PATENT DOCUMENTS

| | | | |
|---|---|---|---|
| 2935691 | 3/1981 | Germany | 220/602 |
| 184922 | 7/1935 | Switzerland | 220/602 |

OTHER PUBLICATIONS

HOWW Collectibles—compartment glassware & shot glasses.

HOWW Collectibles—acrylic party glasses.

*Primary Examiner*—Joseph M. Moy

*Attorney, Agent, or Firm*—James Creighton Wray; Meera P. Narasimhan

[57] ABSTRACT

A shot glass is formed with a sloping, slightly tapered side wall. A curved cup bottom wall extends across the bottom of the shot glass and is spaced upward from the bottom edge of the shot glass side wall. The cup bottom wall has a thicker central portion and a thinner annular peripheral portion, and upper and lower surfaces of the cup bottom wall are formed with different radii of curvature. The bottom surface has a larger radius and the upper surface has a smaller surface for forming a lens. The base has a base wall and a peripheral side wall which extends upward from the base wall. A thin peripheral ring extends downward from outer edges of the base wall to form a foot. The cylindrical side wall of the base has a flat upper surface on which is formed an energy directing bead. The side wall of the base fits inside a bottom edge of the shot glass, and the energy directing bead contacts an inner step in the shot glass side wall slightly above the lower edge. When the base and shot glass are pressed together and ultrasonic energy is applied, the energy directing bead focuses energy to soften the step and the flat wall and fuse the two together, sealing the base and shot glass. Objects are placed between the base wall and cup bottom wall in the cavity formed therebetween before sealing the base to the shot glass. One base wall has upward formed lenticules which lift and tip precision-cut confetti shapes, which are magnified by the cup bottom wall.

20 Claims, 2 Drawing Sheets

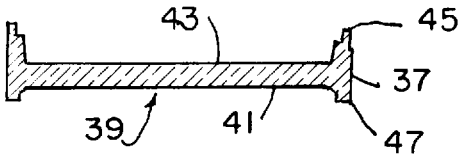
FIG. 7
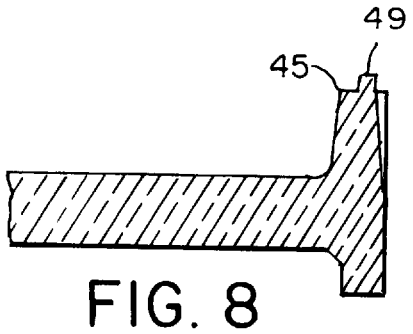
FIG. 8
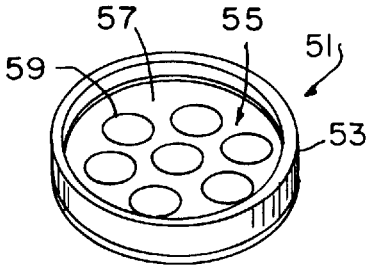
FIG. 9
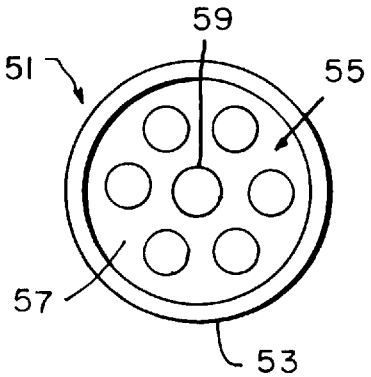
FIG. 10
FIG. 11
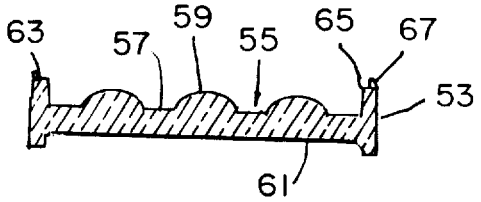
FIG. 12
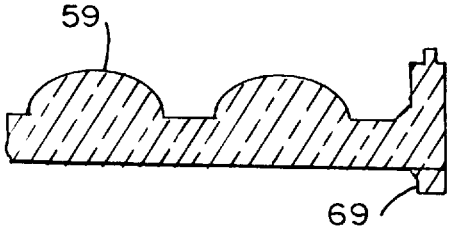

SHOT GLASS

This application is a continuation of application No. 08/678,704, filed Jul. 11, 1996, now abandoned.

BACKGROUND OF THE INVENTION

Shot glasses have long existed. Primarily, shot glasses are formed of glass, often with thick walls and bottom, and with markings to indicate volumes. Traditional shot glasses are devoid of interest and are primarily functional.

Molded shot glasses have been used, but the primary purpose of the molded shot glass has been to measure and hold an amount of liquid for mixing or drinking.

A need exists for shot glasses which are decorative and functional in providing, holding and enhancing decorations, as well as being functional for measuring and holding liquids.

SUMMARY OF THE INVENTION

A shot glass is formed with a sloping, slightly tapered side wall. A curved cup bottom wall extends across the bottom of the shot glass and is spaced upward from the bottom edge of the shot glass side wall. The cup bottom wall has a thicker central portion and a thinner annular peripheral portion. Upper and lower surfaces of the cup bottom wall are formed with different radii of curvature. The bottom surface has a larger radius and the upper surface has a smaller radius for forming a lens.

A shot glass base has a base wall and a peripheral side wall which extends upward from the base wall. A thin peripheral ring extends downward from outer edges of the base wall to form a foot.

The cylindrical side wall of the base has a flat upper surface on which is formed an energy directing bead. The side wall of the base fits inside a bottom edge of the shot glass, and the energy directing bead contacts an inner step in the shot glass side wall slightly above the lower edge. When the base and shot glass are pressed together and ultrasonic energy is applied, the energy-directing bead focuses energy to soften the bead, the step and the flat wall and fuse them together, sealing the base and shot glass.

Objects are placed between the base wall and cup bottom wall in the cavity formed therebetween before sealing the base to the shot glass. The lens in the bottom of the shot glass changes apparent shape, size and position of the objects.

One base wall has upward formed lenticules which lift and tip precision-cut confetti shapes, which are magnified by the cup bottom wall.

A preferred molded shot glass has a side wall extending downward and inward to a bottom. A cup bottom extends across the bottom of the side wall. An energy directing bead step is positioned inside a bottom edge of the side wall beneath the cup. A base has a disc-shaped based wall. A support ring extends downward from a peripheral portion of the base wall. A side wall extends upward from a peripheral portion of the base wall. The base side wall has a flat upper surface. An energy directing bead is formed on the flat upper surface. The flat upper surface fits up against the inner step at the lower end of the shot glass side wall. The energy bead is welded and fused to the step to join the base and shot glass.

Preferably the cup bottom has a thicker central portion and a thinner peripheral portion in engagement with the shot glass side wall for forming a lens for magnification of details in the space between the cup bottom and the base wall.

In a preferred embodiment, the cup bottom has lower and upper surfaces formed respectively on first and second radii. The first radius is longer than the second radius, thereby forming a thicker portion of the cup bottom at its center and a thinner portion of the cup bottom at its periphery, forming a lens for magnification of objects through the cup bottom.

The shot glass side wall has a generally truncated conical and cylindrical shape with a wide mouth at the top and a bottom edge which is narrower than the wide mouth. The shot glass side wall tapers downwardly and inwardly to the cup bottom and then extends cylindrically downward to a bottom edge of the side wall. Preferably the taper extends to the bottom edge. An inside step in the bottom edge has a cylindrical wall and an axial wall.

The base has a side wall with an upper edge which fits against a step in the bottom edge of the cup side wall. The bottom, outer side of the base wall is a flat surface; an opposite, inner surface has lenticules. The lenticules are formed as spheroidal bumps on the upper surface. Each of the lenticules has an identical radius. The raised lenticules on the upper, inner surface of the base wall lift and tip objects positioned above the base wall and between the base wall and cup bottom. Confetti objects placed between the base wall and the cup bottom are held within the base side wall.

These and further and other objects and features of the invention are apparent in the disclosure, which includes the above and ongoing written specification, with the claims and the drawings.

BRIEF DESCRIPTION OF THE DRAWINGS

FIG. 7 is a cross-sectional elevation of the shot glass base shown in FIGS. 5 and 6.

FIG. 8 is an enlarged cross-section elevational detail of the shot glass base shown in FIG. 7.

FIG. 9 is a perspective view of a preferred shot glass base.

FIG. 10 is a plan view of the shot glass base shown in FIG. 9.

FIG. 11 is a cross-sectional elevational view of the shot glass base shown in FIGS. 9 and 10.

FIG. 12 is an enlarged elevational cross-sectional detail of the shot glass base shown in FIG. 11.

DETAILED DESCRIPTION OF THE PREFERRED EMBODIMENTS

Figure 1:
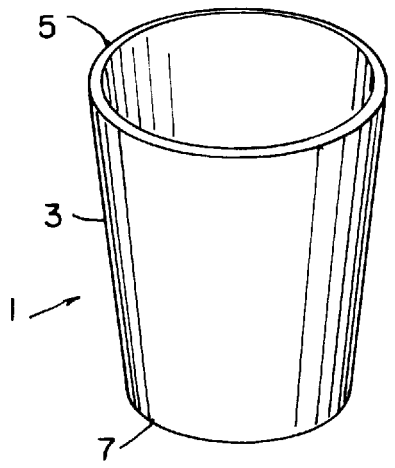
FIG. 1 is a perspective view of a cup portion of the new shot glass.

Referring to FIGS. 1–4, a cup 1 has a side wall 3 which is circular in cross-section and which slopes downward and inward from a wider upper mouth 5 to a lower end 7. The upper mouth has a small radius 9 along its upper edge to provide smoothness.

Figure 2:
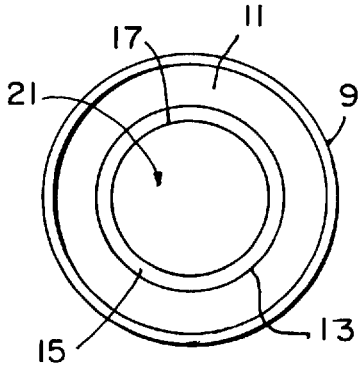
FIG. 2 is a top plan view of the shot glass cup portion.
Figure 3:
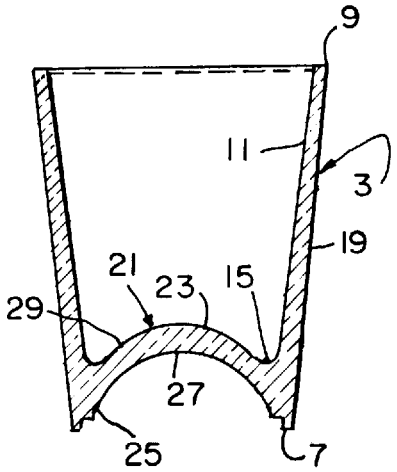
FIG. 3 is a lateral cross-section of the shot glass cup portion shown in FIGS. 1 and 2.

FIGS. 2 and 3 show the inside 11 of the side wall 3 and the bottom edge 13 of the inside surface, which has a small annular depression 15 leading to the outer edge 17 of the cup bottom 21.

As shown in FIG. 3, the shot glass side wall 3 has an outer surface 19 which is sloped with a slight divergence from the inner wall 11 to provide a slightly tapered wall that is thinner at the top and thicker at the bottom. The cup bottom 21 varies in thickness, with a wider center 23 and a thinner peripheral edge 25 to form a lens. The lower surface 27 and upper surface 29 of the cup bottom 21 are formed with different radii. The lower surface 27 has a longer radii than the upper surface 29, to form the thick center 23 and thinner peripheral portion 25 and to create the lens.

Figure 4:
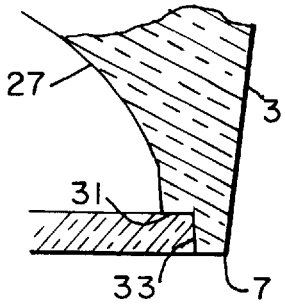
FIG. 4 is a bottom cross-sectional detail of the shot glass cup portion shown in FIGS. 1, 2 and 3.

As shown in FIG. 4, the bottom edge 7 of the side wall 3 is formed with an inward step 31 to receive an energy directing bead for welding. The cylindrical inner wall 33 receives a side wall of a base, which is ultrasonically welded to the step 31.

Figure 5:
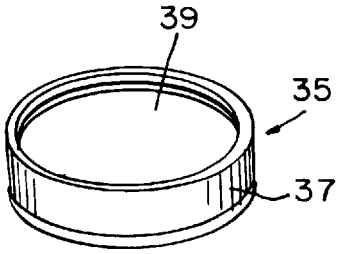
FIG. 5 is a perspective view of a base of the new shot glass.
Figure 6:
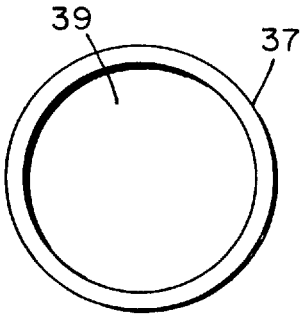
FIG. 6 is a top plan view of the base shown in FIG. 5.

FIG. 5 shows one base 35 in a perspective view. The base has a side wall 37 and a base wall 39, as shown in FIG. 6.

The base wall 39 as shown in FIGS. 7 and 8 has a flat lower surface 41 and a flat upper surface 43. The side wall 37 has a flat upper surface 45. A ring 47 provides a foot for the shot glass base.

As shown in FIG. 8, the flat upper surface 45 has an energy directing bead 49 which focuses ultrasonic energy and fuses into the wall 31, joining walls 31 and 45 when the shot glass and base are pressed together, fused and joined by ultrasonic welding.

A preferred base 51 is shown in FIGS. 9–12. The base has a side wall 53 and a base wall 55, with an upper surface 57 on which multiple lenticules 59 are formed.

FIG. 10 shows a plan view of the base in which one of the lenticules 59 is centered and six lenticules are equally spaced from each other and from the center lenticule.

As shown in FIG. 11, the base 55 has a flat lower wall 61 and the upper wall 57 on which spheroidal surfaces are formed to form the lenticules 59. The side wall 53 has an upstanding inner portion 63, topped by a flat surface 65 on which the energy directing bead 67 is formed.

A ring 69 extends downwardly from the outer peripheral portion of the base 55, as shown in FIG. 12, to form a foot.

Confetti with particular outlines and colors is placed on top of the base before the base is assembled and welded to the shot glass. The lenticules 59 raise and tip the confetti, providing a three-dimensional arrangement of the confetti within the base of the shot glass. The lens-like cup bottom of the shot glass focuses and enlarges particular pieces of confetti and emphasizes the three-dimensional space at the bottom of the shot glass.

The shot glass and base may be constructed of any suitable material. One preferred material for construction of the shot glass is polystyrene. The cup volume equals 1.25 ounces at the fill line, which is scribed, engraved or printed just below the top of the shot glass, preferably on the inside 11 of the side wall 3. Varying wall thickness on the cup bottom wall provides magnification.

All parting lines and gate locations are on the lower end of the cup. The parts are free of sinks and molding imperfections and, when physically joined by welding, appear to be one complete glass structure.

The energy directing bead is located between shelves which are hidden from the side wall, so that the entire shot glass gives the appearance of a uniformly formed glass with a sealed cavity between the cup bottom and the base wall. The base side wall is set inward from the outer surface of the lower end of the shot glass side wall to completely cover all joints.

The plain bottom without the lenticules may be used to provide a cavity which is filled with three-dimensional objects or flat representations. The lens cup bottom wall of the shot glass focuses those objects and makes them appear to stand out within the cavity while looking directly through the top of the shot glass or while looking at the objects through the side wall of the shot glass and the curved cup bottom wall.

While the invention has been described with reference to specific embodiments, modifications and variations of the invention may be constructed without departing from the scope of the invention, which is defined in the following claims.

I claim:

1. A molded shot glass comprising a side wall extending downward and inward to a bottom, a cup bottom extending across the bottom of the side wall spaced from a bottom edge of the side wall, the cup bottom having first and second curved surfaces, and an energy directing bead receiving step positioned inside the bottom edge of the side wall beneath the cup bottom, a base having a disc-shaped base wall, a support ring extending downward from a peripheral portion of the base wall, a base side wall extending upward from a peripheral portion of the base wall, the base side wall having a flat upper surface and an energy directing bead formed on the flat upper surface, the flat upper surface fitting within the step at the lower end of the shot glass side wall and the energy directing bead being welded and fused to the step to join the base and shot glass.

2. The apparatus of claim 1, wherein the cup bottom has a thicker central portion and a thinner peripheral portion in engagement with the shot glass side wall forming a lens for magnification of details in the space between the cup bottom and the base wall.

3. The apparatus of claim 1, wherein the cup bottom has lower and upper surfaces formed respectively on first and second radii, and wherein the first radius is longer than the second radius, thereby forming a thicker portion of the cup bottom at its center and a thinner portion of the cup bottom at its periphery, and forming a lens for magnification of objects through the cup bottom.

4. The apparatus of claim 1, wherein the shot glass side wall has a generally truncated conical shape with a wide mouth at the top and a bottom edge which is narrower than the wide mouth.

5. The apparatus of claim 4, wherein the shot glass side wall tapers upwardly and outwardly to the mouth.

6. The apparatus of claim 1, wherein the base wall comprises a flat surface and an opposite surface having lenticules, and wherein the lenticules are formed as spheroidal bumps on the opposite surface.

7. The apparatus of claim 6, wherein each of the lenticules has an identical radius.

8. The apparatus of claim 6, wherein the raised lenticules are in the upper inner surface of the base wall for lifting and tipping objects positioned above the base wall and between the base wall and cup bottom.

9. The apparatus of claim 8, further comprising confetti objects placed between the base wall and the cup bottom and held within the base side wall.

10. The molded shot glass of claim 1, wherein the cup bottom has a thicker central portion and a thinner peripheral portion in engagement with the shot glass side wall forming a lens for magnification of details in the space between the cup bottom and the base wall, wherein the cup bottom has lower and upper surfaces formed respectively on first and second radii, and wherein the first radius is longer than the second radius, thereby forming a thicker portion of the cup bottom at its center and a thinner portion of the cup bottom at its periphery, and forming a lens for magnification of objects through the cup bottom.

11. The apparatus of claim 10, wherein the shot glass side wall has a generally truncated conical shape with a wide mouth at the top and a bottom edge which is narrower than the wide mouth.

12. The apparatus of claim 11, wherein the shot glass side wall tapers upwardly and outwardly to the mouth.

13. The apparatus of claim 10, wherein the base wall comprises a flat surface and an opposite surface having lenticules, and wherein the lenticules are formed as spheroidal bumps on the opposite surface.

14. The apparatus of claim 13, wherein each of the lenticules has an identical radius.

15. The apparatus of claim 13, wherein the raised lenticules are in the upper inner surface of the base wall for lifting and tipping objects positioned above the base wall and between the base wall and cup bottom.

16. The apparatus of claim 15, further comprising confetti objects placed between the base wall and the cup bottom and held within the base side wall.

17. The shot glass of claim 1 wherein the side wall is a sloping, slightly tapered side wall, and wherein the cup bottom has a thicker central portion and a thinner annular peripheral portion, and the first and second surfaces of the cup bottom being formed with different radii of curvature, the bottom surface having a larger radius and the upper surface having a smaller radius for forming a lens.

18. The shot glass of claim 17, further comprising a base having a base wall and a cylindrical side wall which extends upward from the base wall, a thin peripheral ring extending downward from outer edges of the base wall forming a foot, the cylindrical side wall of the base having a flat upper surface on which is formed an energy directing bead, the side wall of the base fitting inside a bottom edge of the shot glass, and the energy directing bead contacting an inner step in the shot glass side wall slightly above the lower edge.

19. The shot glass of claim 18, wherein the base and the side wall of the shot glass are pressed together and ultrasonic energy is applied, the energy directing bead focuses energy softens the step and the flat wall and fuses the two together, sealing the base and shot glass and objects placed between the base wall and cup bottom wall in the cavity formed therebetween before sealing the base to the shot glass.

20. The shot glass of claim 18, wherein the base wall has upward formed lenticules which lift and tip precision-cut confetti shapes, which are magnified by the cup bottom wall.

* * * * *